United States Patent [19]

Davis et al.

[11] Patent Number: 5,042,816

[45] Date of Patent: Aug. 27, 1991

[54] BIBLICAL QUESTION AND ANSWER BOARD GAME

[76] Inventors: Tracy L. Davis, 115 Washington St.; Richard R. Cimakasky, 21 W. Second St., both of Wind Gap, Pa. 18091

[21] Appl. No.: 607,721

[22] Filed: Oct. 1, 1990

[51] Int. Cl.[5] ..... A63F 3/00

[52] U.S. Cl. ..... 273/243; 273/431

[58] Field of Search ..... 273/242, 243, 248, 249

[56] References Cited

U.S. PATENT DOCUMENTS

| | | | |
|---|---|---|---|
| 3,939,578 | 2/1976 | Coffey | 273/243 |
| 4,013,294 | 3/1977 | Smeda et al. . | |
| 4,121,823 | 10/1978 | McBride | 273/249 |
| 4,201,388 | 5/1980 | Cantelon | 273/251 |
| 4,216,971 | 8/1980 | Lyke . | |
| 4,273,337 | 6/1981 | Carrera et al. | 273/243 |
| 4,363,628 | 12/1982 | Kirkpatrick et al. | 273/256 |
| 4,807,878 | 2/1989 | Tripp | 273/237 X |
| 4,884,816 | 12/1989 | Ford et al. | 273/240 |
| 4,934,709 | 6/1990 | Peterson | 273/249 |

FOREIGN PATENT DOCUMENTS

| | | | |
|---|---|---|---|
| 2208269 | 3/1989 | United Kingdom | 273/251 |

*Primary Examiner*—Edward M. Coven
*Assistant Examiner*—William E. Stoll
*Attorney, Agent, or Firm*—Kenneth P. Glynn

[57] ABSTRACT

The present invention is directed toward an educational and entertaining game that challenges the players knowledge of the Bible. The game is played by rolling a die and moving a game piece the appropriate number of spaces. Each gameboard space has an instruction thereon, that tells the player what to do. The objective of the game is to acquire a predetermined number of points before your competitors. Points are gained by landing on an appropriate gameboard space which indicates a point reward for the correct answer to a Bible question. The gameboard spaces are so varied as to provide multiple options. Three sources of Bible questions exist depending upon the gameboard space encountered. Additionally, gameboard spaces are randomly positioned through out the gameboard that cause the players to surrender points to the bank or other players. Success in the game is dependent upon knowledge of the writings contained within the Bible. Answers to the various questions are provided, but Bible citations are also included so that the answer can be directly obtained from the Bible. Pathways between sections of the gameboard exist that may acquire a player to answer a specialized area of Bible based trivia. The difficulty and pace of the game are so designed as to challenge a player into learning all aspects of the Bible while having fun and interaction with other players.

11 Claims, 4 Drawing Sheets

BIBLICAL QUESTION AND ANSWER BOARD GAME

BACKGROUND OF THE INVENTION

1. Field of the Invention

The present invention is directed toward a educational and entertaining game apparatus that teaches, tests and rewards a players knowledge of The Bible, and more particularly to such game apparatus that allow a player to advance around and across a gameboard in pursuit of points by correctly answering questions taken from specific areas of The Bible.

2. Prior Art Statement

Board games have been a popular source of entertainment and education for decades. Hundreds of boardgames have been created to teach spelling, grammar, vocabulary, math and other such skills, while providing a learning medium that is both entertaining and interesting. With such games, players, especially children, tend to learn information more quickly and retain that information longer, than with tradition classroom approaches to learning.

Many traditional boardgames exist that, require players to move around and across a game board with the role of a die. In such traditional games, the goal is often to acquire, or spend as much as possible. Still other traditional board games are trivia based and winning is determined by the first person to cross a finish line by correctly answering questions. Although games exist that combine the two types of traditional boardgames, no such games exist that combine these traditional game elements in such a way as to show the physical layout or foster the learning effect of the present invention.

The present invention is based on The Bible, and the design of the game is such as to promote awareness of The Bible and a personal moral awareness. Prior art such as U.S. Pat. No. 4,013,294 to Smeda et al and U.S. Pat. No. 4,216,971 to Lyke show gameboards based on the psychological effects of varying human experiences and personality needs through the religious viewpoint and teachings of The Bible. Thus, although prior art does show games with similar physical gameboard layouts as the present invention, prior art does not show the variances of questioning options, the interaction of the players, or the multitude of options during play that is combined with the physical playing pattern of the present invention an is expressed in the following specifications.

SUMMARY OF THE INVENTION

The present invention is directed toward an educational entertaining game that challenges the players knowledge of The Bible. The game is played by rolling a die and moving a game piece the appropriate number of spaces. Each gameboard space has an instruction thereon, that tells the player what to do. The objective of the game is to acquire a predetermined number of points before your competitors. Points are gained by landing on an appropriate gameboard space which indicates a point reward for the correct answer to a Bible question. The gameboard spaces are so varied as to provide multiple options. Three sources of Bible questions exist depending upon the gameboard space encountered. Additionally, gameboard spaces are randomly positioned through out the gameboard that cause the players to surrender points to the bank or other player.

Success in the game is dependent upon knowledge of the writing contained within The Bible. Answers to the various questions are provided, but Bible citations are also included so that the answer can be directly obtained from The Bible. Pathways between sections of the gameboard exist that may require a player to answer a specialized area of Bible based trivia. The difficulty and pace of the game are so designed as to challenge a player into learning all aspects of The Bible while having fun and interaction with other players.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE INVENTION

Figure 1:
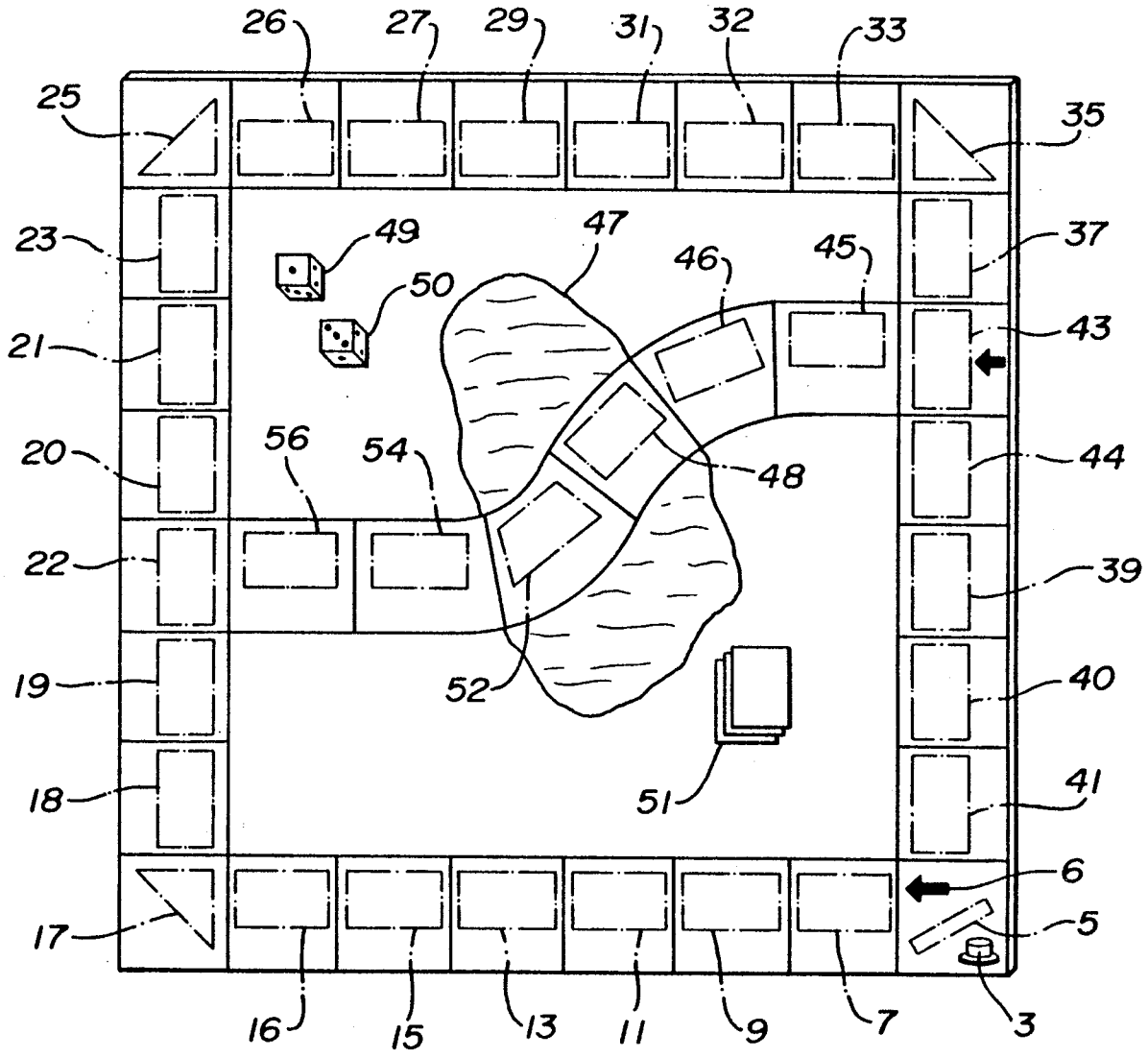
FIG. 1 shows one preferred embodiment for the gameboard layout for the present invention.

The present invention is, as mentioned, directed towards a game apparatus that provides an educational and entertaining medium through which study of The Bible can be facilitated. The general objective of the game is to be the first to obtain a predetermined amount of points. The length of time the game is to be played determines how many points are needed to win. The logic of the gameboard and the rules of play are best described when referring to the drawings. Since all Figures refer to components of the present invention game apparatus, FIGS. 1 through 7 must be considered together as comprising one full preferred embodiment of the present invention. Referring first to FIG. 1, the gameboard 1 is readied for play in the following manner. Each player chooses a colored game piece 3 and places that piece on the starting square 5 of the gameboard. Although only one game piece 3 is shown, there is no limit as to the number of players who may want to participate in the game. The faith building cards 51 are then placed onto the gameboard 1 and the dice 45 and 50 are positioned for easy access.

Figure 2:
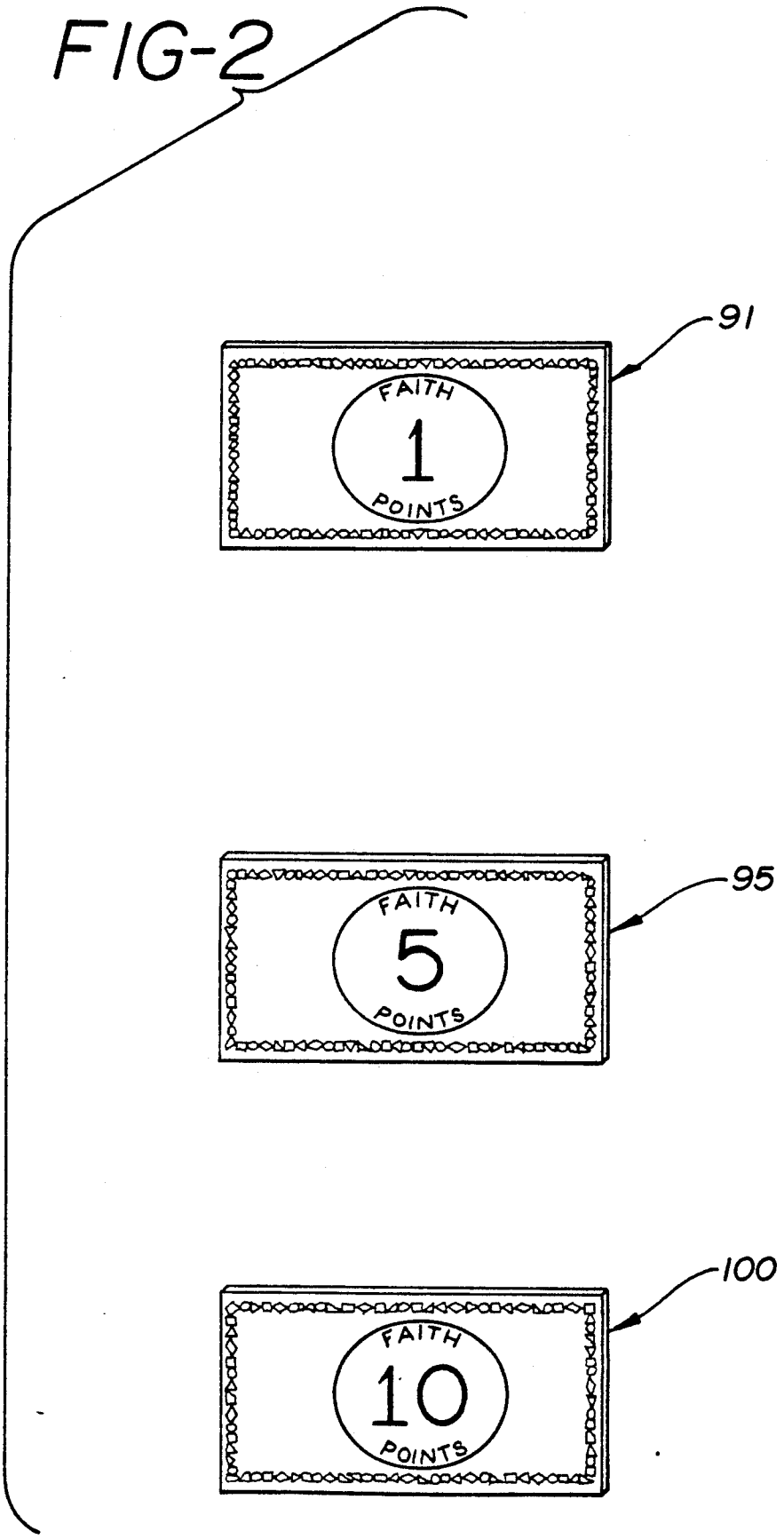
FIG. 2 shows one embodiment for the points tendered within the present invention.
Figure 3:
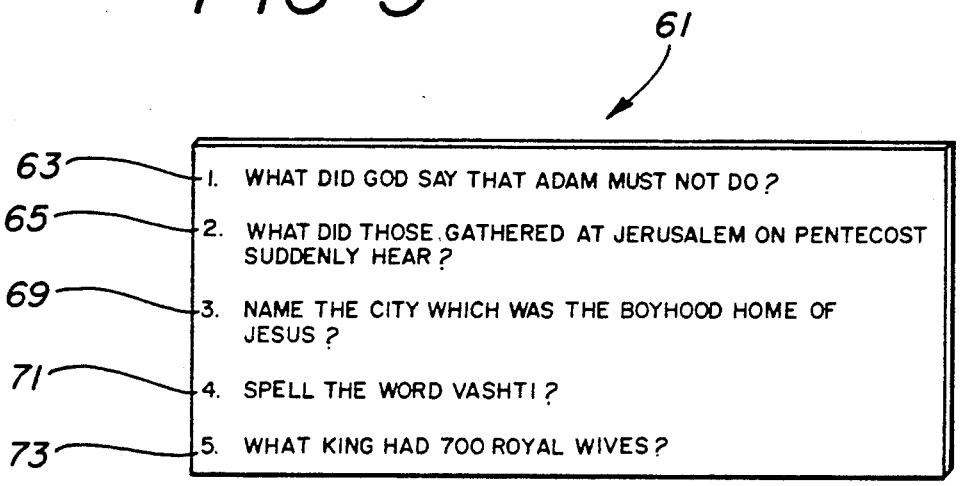
FIG. 3 shows the front view of one preferred embodiment for one sample question card.
Figure 4:
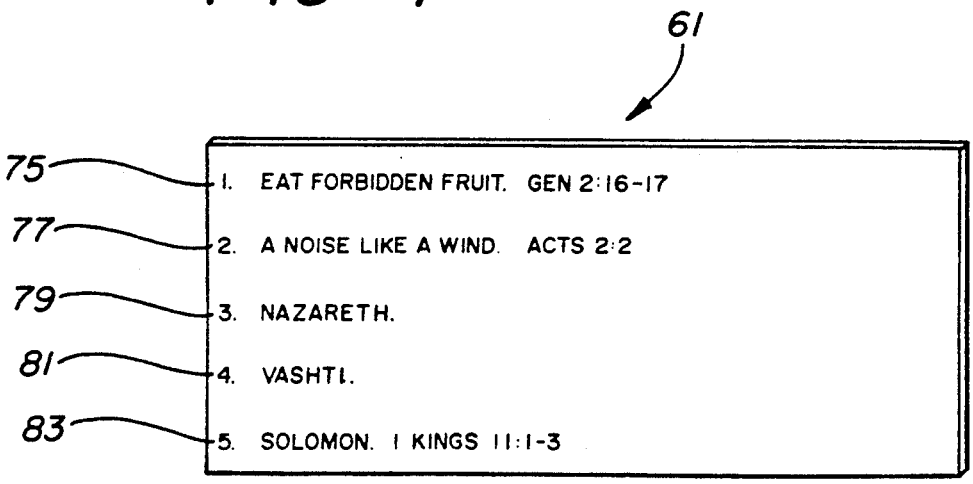
FIG. 4 shows the reverse view of FIG. 3 showing the answers to the questions sampled in FIG. 3.

Referring now to FIG. 2 there are shown three denominations for point markers, a one point marker 91, a five point marker 95 and a ten point marker 100. To begin the game each player is given ten points worth of markers (preferably one-five point marker 95 and five-point markers 91). The balance of markers not used in the initial player distribution are held off to the side and are considered the bank for purposes of the game rules.

To start the game each player picks up the dice 49, and 50 (or die) and rolls to see who has the lowest number. The low roller plays first and the other players follow in either a clockwise or counter-clockwise fashion. Once the order of play is decided the first play rolls the dice 49, and 50 (or die) and moves his or her colored playing piece 3 from the start square 5 forward the appropriate number of spaces in the direction indicated by the start arrow 6. If a player lands upon a space that has an indicia or text referring to a faith building question space 13, 23, 27, 44 then the player must take a faith building card 51 from the gameboard 1. The faith building cards are specialized, and in this preferred embodiment the faith building cards 51 ask specific questions from the biblical accounts of the life of Jesus. The question taken from the faith building cards 51 is answered correctly the player receives the advantages indicated through the text of that space 13, 23, 27, 44 on the gameboard 1.

If a person lands upon a space 9, 16, 18, 23, 26, 32, 40 having an indicia or text relating to the multiple question cards 61, one of the player competitors is required to pick a multiple question card 61 (see FIGS. 3 and 4) from a deck. The multiple question cards 61 are two sided cards. One side of the card (FIG. 3) has five questions 63, 65, 69, 71, 73, and the reverse side of the card (FIG. 4) has the answers 75, 77, 79, 81, 83, that correspond to the questions. The player that lands on these spaces must role one die (either 49 or 50). The number rolled will determine the subject matter of the question. In the present embodiment shown. If the player roles a one, a question from the Old Testament 63 will be asked, if a two is rolled a New Testament question 65, for a three a biblical place question 69, for a four a biblical words question 71, and for a five a general Bible trivia question 73. If a six is rolled the player has a choice of the five other topic areas. If the player correctly answers the question, the player is entitled to the advantage indicated on that space of the gameboard.

Figure 5:
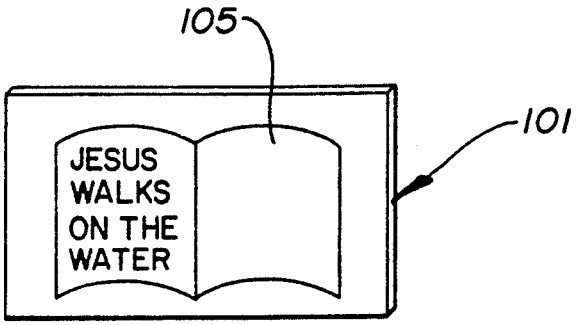
FIG. 5 shows the front view of one preferred embodiment for a sample specialty path card used within the present invention.
Figure 6:
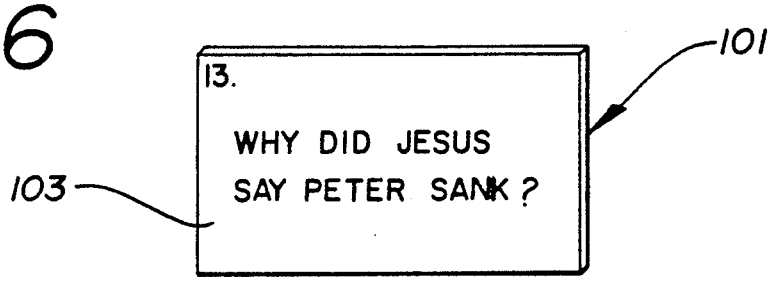
FIG. 6 shows the reverse view of FIG. 5.
Figure 7:
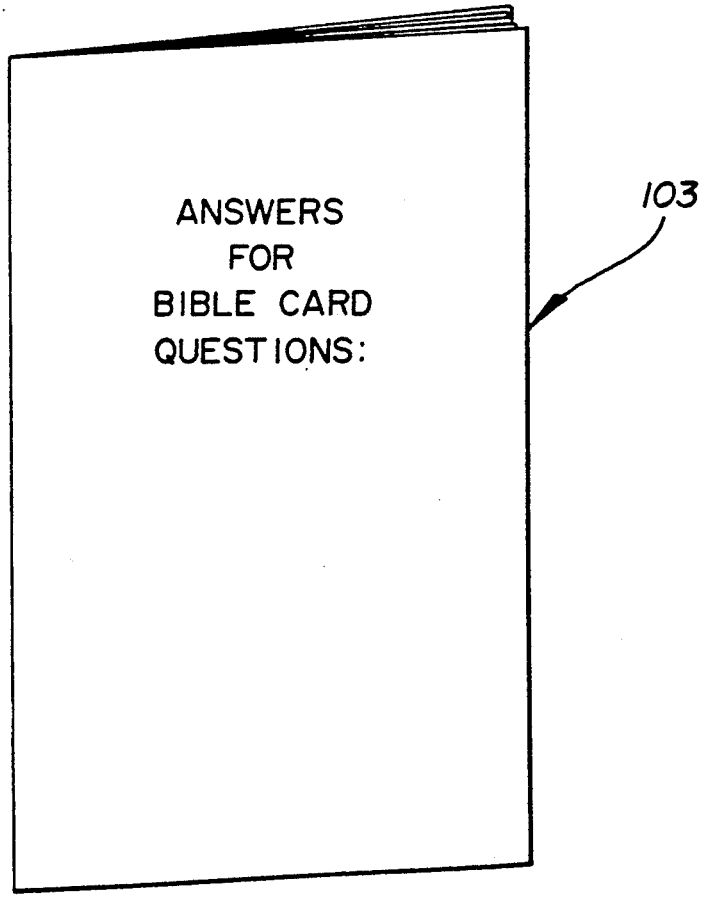
FIG. 7 shows the front view of one embodiment for the answer book that would correspond to the specialty question cards shown in FIGS. 3 and 5.

If a player lands on a specialty path square 43 than that player is entitled to cross across the middle of the gameboard 1. Each indicia or text on specialty spaces 45, 46, 48, 52, 54, 56 across the specialty path corresponds to specialty question cards 101 that require the player to answer a question from a very specific area of the Bible. In FIG. 5 there is shown the top side of a specialty card 101. The top of the card has an indica 105 printed onto it that indicates what specific area of biblical trivia is being question. For the embodiment shown, the biblical event of when "Jesus Walks on the Water" is being tested. FIG. 6 shows the reverse side of the specialty card 101 and shows a sample question 103. A correct answer to a question allows the player to continue across the specialty path until the player again enters the main path of the gameboard 1. It should be noted that although only one specialty path is shown in the embodiment, representing only one specialized area of knowledge, other paths and areas can be added in differing embodiments.

In addition to the question spaces on the board there exist spaces that have text 7, 11, 19, 21, 29, 37, 41 written thereon that provide for automatic penalties and reward spaces 17, 25, 35, that add and subtract points from players based on luck, still other board spaces have text 15, 33, 39 that require a player to recite from memory a biblical reference for additional points. Answers to faith building questions 51 or specialty question along specialty path 43 are located within an answer book 103 (see FIG. 7). However both the faith building questions 51 and the specialty questions have biblical citations at the ends of each question so that the answer can be directly referenced from a Bible.

What is claimed is:

1. A boardgame apparatus comprising:

(A) A plurality of distinguishable, moveable player pieces representing individual players;

(B) A means for randomly selecting a number, corresponding to the movement of a player;

(C) A plurality of multiple question cards, each said card having a plurality of questions printed on one side, and the answers to said question printed on said card's reverse side;

(D) A plurality of decks of single question cards, each card in each said deck having an identifying indicia on one side and a single question printed on said card's reverse side;

(E) A continuous path atop a gameboard, said continuous path following the periphery of said gameboard, and said path including:

(a) A plurality of single question stations, whereon a distinctive identifying indica is printed, corresponding to a said deck of single question cards, and indicating a point value for the proper answer to said question printed on said single question card;

(b) A plurality of choice question stations, whereon is printed a point value for the proper response to one said question on said multiple question card, said question on said multiple question card being chosen by said means for randomly selecting a number;

(c) A plurality of penalty stations, whereon is printed a point value to be automatically lost by the players;

(d) A plurality of bonus stations whereon is printed a point value to be automatically gained by the players; and, (e) A plurality of player action stations whereon is printed a task and a point valve for the proper execution of said printed task;

(F) At least one specialty route connecting at least two said stations along said continuous path, said specialty route having a plurality of consecutive spaces therealong, each said space having a distinctive identifying indica printed thereon, corresponding to one said deck of single question cards, and indicating a point valve for the proper answer to said question printed on said single question card; and, (G) A plurality of point tokens, for exchange among the players, each said token having a point valve printed thereon.

2. The game apparatus of claim 1 wherein said means of randomly selecting a number is a set of dice, rolled by the players.

3. The game apparatus of claim 1 wherein said multiple question cards have at least five questions and answers printed thereupon.

4. The game apparatus of claim 3, wherein the first said question and said answer printed on said multiple question cards are based upon information contained in The Old Testament of The Bible.

5. The game apparatus of claim 4, wherein the second said question and said answer printed on said multiple question cards are based upon information contained within The New Testament of The Bible.

6. The game apparatus of claim 5, wherein the third said question and said answer printed on said multiple question cards are based upon information about places mentioned in The Bible.

7. The game apparatus of claim 6, wherein the fourth said question and said answer printed on said multiple question cards are based on uncommon words used in The Bible.

8. The game apparatus of claim 7, wherein the fifth said question and said answer printed on said multiple question cards are based on biblical trivia.

9. The game apparatus of claim 1, wherein each said deck of single question cards has questions based upon The New Testament of The Bible.

10. The game apparatus of claim 1, wherein each said question printed within said plurality of decks of single question cards, also includes the printed Bible citation that allow a player to find the answer in the Bible.

11. The game apparatus of claim 1, wherein the answer to each said question printed within said plurality of decks of single question cards is printed within an answer booklet.

* * * * *